US005079560A

United States Patent [19]

Sakurai et al.

[11] Patent Number: 5,079,560

[45] Date of Patent: Jan. 7, 1992

[54] VEHICLE WINDOW ANTENNA

[75] Inventors: Kaoru Sakurai, Kawasaki; Harunori Murakami, Machida; Hiroshi Iijima; Hajime Murakami, both of Yokohama, all of Japan

[73] Assignee: Nippon Sheet Glas Co., Ltd., Osaka, Japan

[21] Appl. No.: 576,160

[22] Filed: Aug. 30, 1990

Related U.S. Application Data

[63] Continuation of Ser. No. 328,998, Mar. 27, 1989, abandoned.

[30] Foreign Application Priority Data

Mar. 30, 1988 [JP] Japan ..... 63-42226

[51] Int. Cl.[5] ..... H01Q 1/32

[52] U.S. Cl. ..... 343/713

[58] Field of Search ..... 343/713, 712, 715, 714, 343/711, 704

[56] References Cited

U.S. PATENT DOCUMENTS

| | | | |
|---|---|---|---|
| 3,810,180 | 5/1974 | Kunert et al. | 343/713 |
| 3,845,489 | 10/1974 | Sauer et al. | 343/713 |
| 3,916,413 | 10/1975 | Davis | 343/712 |
| 3,971,030 | 7/1976 | Sauer | 343/713 |
| 4,072,954 | 2/1978 | Comastri et al. | 343/713 |
| 4,090,202 | 5/1978 | Comastri et al. | 343/713 |
| 4,331,961 | 5/1982 | Davis | 343/713 |
| 4,727,377 | 2/1988 | Yotsuya et al. | 343/713 |
| 4,749,998 | 6/1988 | Yotsuya | 343/713 |
| 4,791,425 | 12/1988 | Yotsuya et al. | 343/713 |
| 4,849,766 | 7/1989 | Inaba et al. | 343/713 |

*Primary Examiner*—Michael C. Wimer
*Assistant Examiner*—Hoanganh Le
*Attorney, Agent, or Firm*—Woodcock Washburn Kurtz Mackiewicz & Norris

[57] ABSTRACT

A vehicle window glass is provided with an antenna to be fit in a window frame of a vehicle such as an automobile. The antenna comprises a plurality of antenna elements which are disposed on a portion of the glass extending generally alongside the window frame. Thus, the antenna elements are spaced from the window frame at a reference or ground potential and preferably close to the sides of the frame. The antenna elements are each designed to have a different length from one another so that they can receive radio waves covering a relatively broad frequency band with a relatively high sensitivity.

6 Claims, 4 Drawing Sheets

VEHICLE WINDOW ANTENNA

This is a continuation of application Ser. No. 328,998, filed Mar. 27, 1989 now abandoned.

BACKGROUND OF THE INVENTION

This invention relates to a vehicle window antenna mounted on a surface of a glass fit in a window frame of a vehicle such as automobile.

Japanese utility model application laid open to public as Kokai Sho-61-197714 discloses a vehicle window antenna of this kind comprising a single antenna element in the from of a strip conductor extending generally alongside a frame of a rear quarter window of an automobile. The length of the antenna strip conductor as well as the distance thereof from the window frame are chosen such that the maximum antenna gain is attained at the center of the desired frequency band, e.g., very high frequency (VHF) band.

With this arrangement, the antenna always provides a relatively high Q factor causing the antenna gain to fall rapidly as the frequency goes farther away from the center point of the maximum gain. Therefore, it is not suitable for a broad-band radio receiver. To state it in another way, such a receiver would require an expensive tuner circuit which can compensate for the antenna characteristics.

It is therefore an object of the invention to provide a vehicle window antenna which overcomes these disadvantages.

SUMMARY OF THE INVENTION

In accordance with the present invention there is provided a vehicle window antenna on a window glass set in a window frame of a vehicle. The antenna comprises a plurality of antenna elements disposed over a portion of the glass which is spaced from the window frame and extends generally parallel thereto. Each antenna element is designed to have an effective length which is different from one another.

With this arrangement, the antenna can respond well to radio signals covering a relatively broad band of frequencies because of the provision of the plurality of antenna elements with a variety of lengths. In addition, the antenna impedance can be easily optimized by selecting and establishing a suitable special relationship between the window frame and the plurality of the antenna elements as well as the choice of the number of such antenna elements whereby a substantial improvement is made on the antenna gain in those frequencies outside the central portion of the reception band.

The window frame may have three or more sides. The plurality of antenna elements are preferably arranged relatively close to the sides of the window frame. The space formed between the plurality of antenna elements and each side of the window frame may be from 20 to 120 mm.

The plurality of antenna elements may be arranged in a concentric pattern.

In a preferred embodiment, each antenna takes the form of a substantial loop.

The antenna of the present invention may be mounted in any suitable window of an automobile, for example, a side window on either side of the automobile.

Each antenna element may comprise one or more printed strip conductors. In a preferred embodiment, at least one of the antenna elements comprises a first strip conductor determining the effective length of the antenna element and an auxiliary or ornamental strip element disposed from one end to the other end of the first strip conductor whereby an almost complete loop is formed by the first and auxiliary strip elements.

BRIEF DESCRIPTION OF THE DRAWINGS

In order that the invention may be better understood, an embodiment thereof will now be described by way of example only and with reference to the accompanying drawings in which.

DETAILED DESCRIPTION OF A PREFERRED EMBODIMENT

Figure 1:
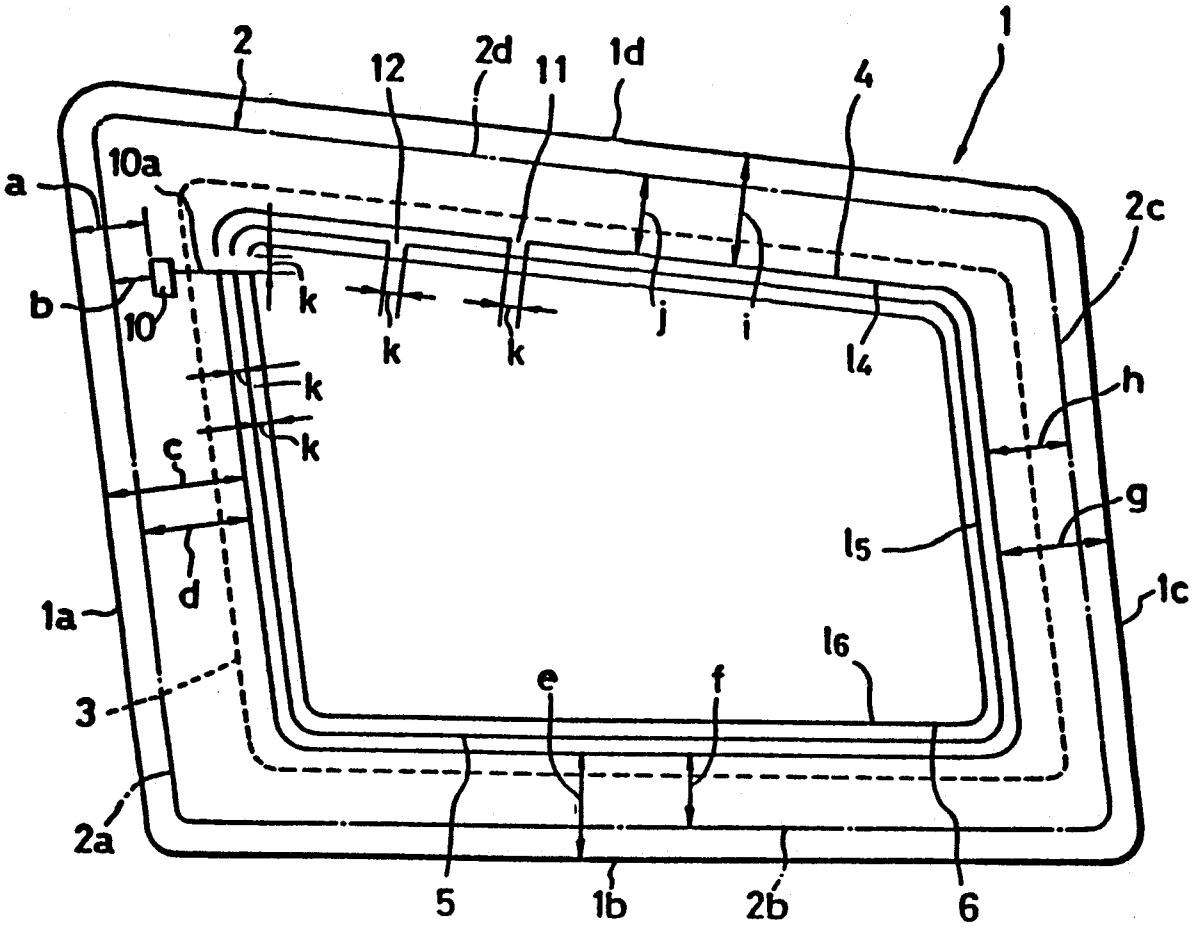
FIG. 1 is a front view of a vehicle window glass having mounted an antenna according to the features of the invention.

Referring first to FIG. 1, these is shown a pane of glass 1 framed in a vehicle window 2, such as rear or rear-quarter window formed on either side of an automobile, e.g., jeep and the like. The window 2 is defined by a frame having four sides 2*a*, 2*b*, 2*c* and 2*d* arranged to generally form a parallelogram window opening. Correspondingly, the glass 1, which is fit in the window frame 2, has four sides 1*a*, 1*b*, 1*c*, and 1*d*. Left-hand toward the front of the automobile while top of FIG. 1 is directed toward the top of the vehicle.

Peripheral portion 3 of the window glass 1 is masked by a colored material such as black ceramic. A feed pad 10 is masked and mounted on a surface of the glass 1 at the left-hand, upper peripheral thereof. An antenna feeder (not shown) typically in the form of a coaxial cable is connected to the pad 10 to supply VHF signals collected on the pad 10 to receiver circuitry. In the window, the feed pad 10 gathers VHF signals from a pattern of antenna elements designated by 4, 5 and 6, mounted on the glass surface and constructed in accordance with the invention. To make connection between the antenna pattern and the pad, a lead 10*a* extends horizontally from the pad 10 to one end of each antenna element 4, 5 and 6. The illustrated antenna elements 4, 5 and 6 as well as the lead 10*a* are all formed by a printed strip conductor having an effective wire gauge of 0.8 mm.

As seen from FIG. 1, the antenna pattern is advantageously disposed over a portion or loop-track of the glass 1 which generally extends parallel to and relatively close to each side 2*a*, 2*b*, 2*c*, 2*d* of the window frame 2. More specifically, the antenna pattern comprises a plurality of, here, three looplike antenna elements 4, 5 and 6 arranged in a concentric manner and each having a figure smaller than but similar to the outline of the glass 1.

Each looplike antenna element 4, 5 and 6 comprises four sides and apparently has a similar length of loop. However, operative or effective length of each antenna element is different from one another. More specifically, the outmost antenna element 4 has a first strip conductor having a length designated l4 and a second strip conductor extending from the one end to the other end of the first strip conductor. There is formed a small space or gap 11 designated k between the first and second strip conductors. It is the first strip conductor that primarily determines the operative length of the antenna element 4. The second strip conductor is ornamental or auxiliary. Similarly, the middle antenna element 5 comprises a first or effective strip conductor having a length designated l5 and a second or ornamental strip conductor extending between the ends of the first strip conductor of the antenna element 5, with a small gap 12 of k formed between the conductors. The innermost antenna element 6, however, consists of a single continuous strip conductor having a length designated l6.

Other dimensional antenna parameters are also shown in FIG. 1. Among them the space or distance formed between the antenna pattern and the sides of the metallic window frame 2 (which may be regarded as a ground) is important because such a space does contributes to the antenna characteristics. In FIG. 1, d indicates the space between the left frame side 2*a* and the left side of the outermost antenna element 4, f the space between the bottom frame side 2*b* and the lower side of the antenna element, h the space between the right sides of frame and antenna element, and j the space between the upper sides thereof. Left, bottom, right and tip margins formed between the antenna element 4 and the corresponding edges of the glass 1 are indicated by c, e, g and i, respectively. There is formed a small gap k between the antenna elements 4, 5 and 6. The corners of each antenna element are rounded. The radiuses of curvature at these corners are as follows: For the outermost antenna element 4, both bottom left and right-hand corners are R15 mm, top right-hand R20 mm and top left-hand R13 mm. The middle antenna element 5 has bottom corners of R10 mm, top right-hand corner of R15 mm and top left-hand corner of R8 mm. The innermost antenna element 6 has bottom corners of R5 mm, top right-hand corner of R10 mm and top left-hand corner of R3 mm.

Reader will note that there are many dimensional parameters in the antenna arrangement of the invention that are suitably chosen for the design of various antennas and once determined, they cooperate with one another to provide the overall antenna performance as desired. Among these parameters, the effective length of each antenna element, the spacial relationship between the antenna elements and the window frame are most critical.

The procedure of designing an antenna normally starts when the reception frequency band is specified. It is assumed, here, that such a band covers VHF or FM broadcasting frequencies from 85 to 110 MHz. Since there are plural antenna elements (three in the case of FIG. 1), it will be convenient to first use a single loop antenna element and find the best arrangement thereof for the preselected frequency band of 85 to 110 MHz.

Figure 2:
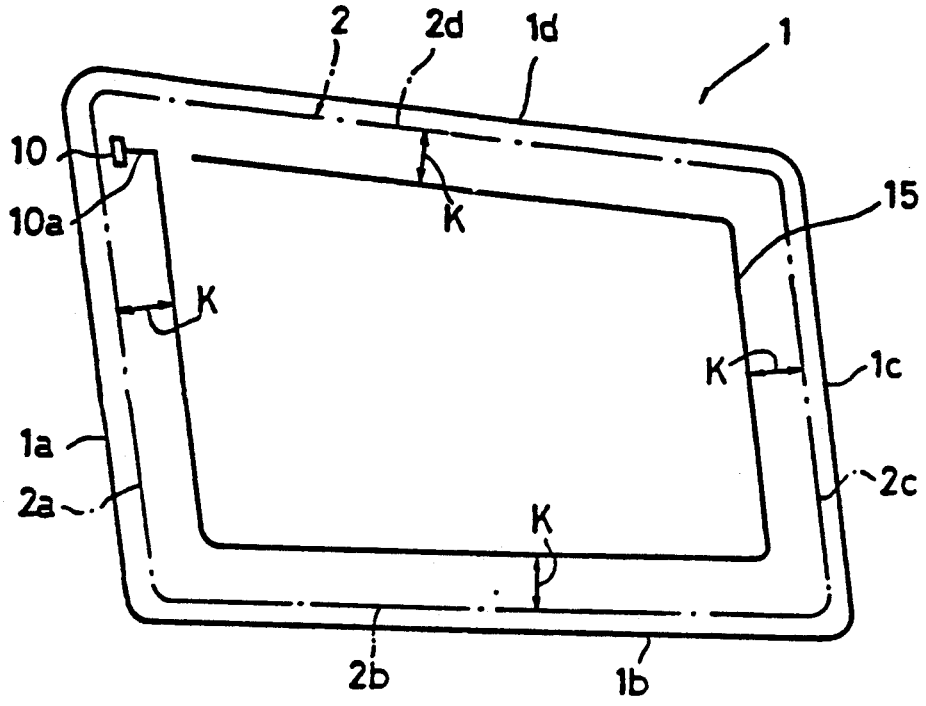
FIG. 2 is a front view of a vehicle window glass, showing a single loop antenna element mounted on a surface of the glass.

FIG. 2 shows such a single loop-like antenna element 15 which may correspond to one of the three antenna elements in FIG. 1, say, the innermost element 6. Now let the space designated K in FIG. 2 formed between the single antenna element 15 and the window frame 2 be given a particular value, tentatively, say, K =70 mm. Then, we will change the length of the element 15.

Figure 3:
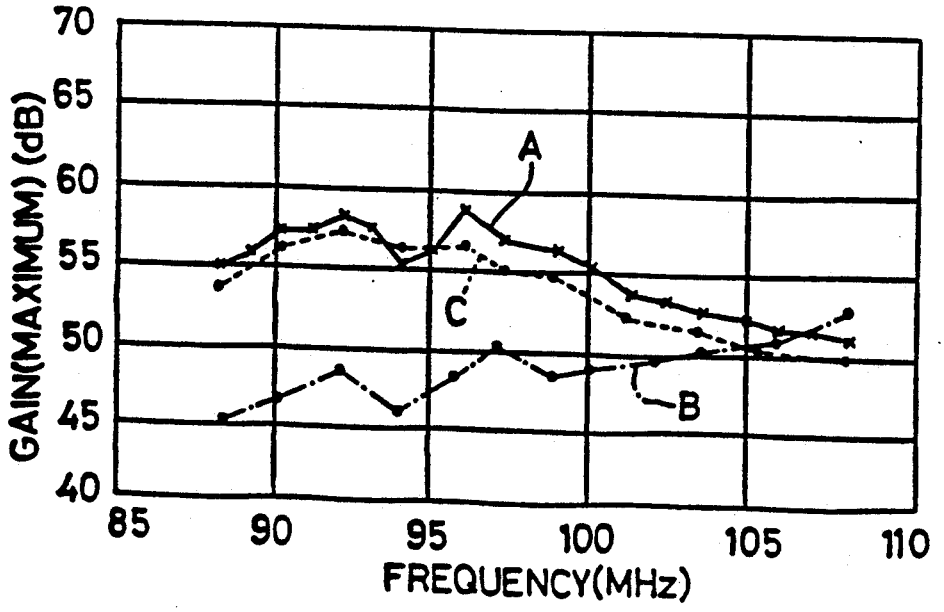
FIG. 3 is a graph showing an antenna gain against frequency for three different lengths of a single antenna element shown in FIG. 2.

FIG. 3 is a graph of antenna gain versus frequency for three different lengths of the antenna element 15. Curve A was obtained with L =1,555 mm. Curve B was plotted with L =1,350 mm and curve C with L =1,750 mm. Obviously, the best curve is A measured for L =1,555 mm which is therefore the optimal antenna length when using a single looplike element for FM band of 85 to 110 MHz. The curve A reaches the maximum gain at or around 96 MHz which approximately corresponds to L =1,555 mm, because we can assume a half-wavelength antenna with $\lambda$ (wavelength) $\approx$1,555 $\times$2.

We will now change the distance K of the single antenna element 15 from the surrounding metallic frame 2 at a ground potential because a change in such spacial relationship is believed to make a change in the antenna impedance of the element 15, a change in the voltage standing wave ratio (VSWR) and a change in antenna gain, each of which is a function of frequency.

Figure 4:
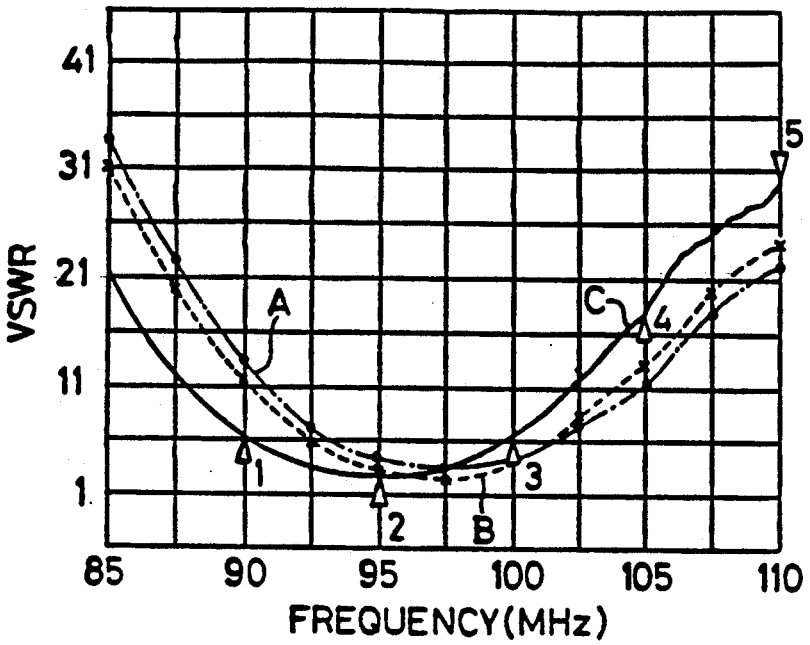
FIG. 4 is a graph showing a voltage standing wave ratio against frequency for several different spaces formed between the single antenna element and the window frame shown in FIG. 2.

FIG. 4 is a graph showing VSWR versus frequency for three different values of distance K. VSWR was measured at the junction between a feeder and a radio receiver. Curve A was obtained with K =70 mm. Curve B was plotted with K =45 mm and curve C with K =35 mm.

Figure 5:
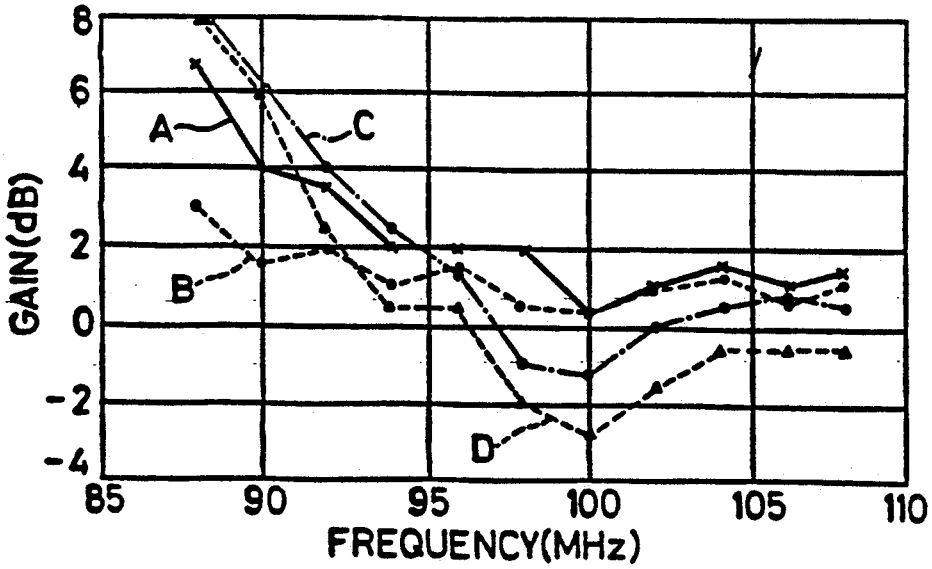
FIG. 5 is a graph showing a relative antenna gain against frequency for several different spaces formed between the single antenna element and the window frame shown in FIG. 2.

FIG. 5 is a graph showing a relative antenna gain against frequency for four different values of the distance K. All curves indicate normalized antenna gains relative to the reference gain obtained with K =70 mm and shown in FIG. 5 by zero dB horizontal line. Curve A was plotted with K =30 mm, curve B with K =45 mm, curve C with K =35 mm and curve D with K =20 mm. The optimal value of K is found to be K =30 mm because the antenna gain curve A for that value of K is best stabilized and increased relative to the reference level over the entire band of frequencies concerned. So far we have found L =1,555 mm and K =30 mm as the optimal dimensional parameters of a single loop antenna element 15 or 4 for receiving FM broadcasting band of 85 to 110 MHz.

According to the teachings of the invention, we will then decide to use a plurality of loop-like antenna elements as illustrated in FIG. 1. In consideration of the best dimensions of a single loop element, its antenna characteristics as well as the targeted range of frequencies, we can find the optimal dimensional parameters of the antenna elements added. From the antenna characteristics of FIGS. 3 to 5, we will see, for example, that the antenna gain in higher frequencies (right-hand side of each graph) is substantially lowered relative to its peak. This problem will be overcome primarily by the addition of antenna element(s) having different length(s) and bearing an appropriate spacial relationship with the metallic or conductive window frame 2.

The test of the antenna arrangement of FIG. 1, which was actually mounted in an automobile, has revealed optimal dimensional parameters thereof as follows. The length l4 of the outermost antenna element 4 is 1,520 mm. The length l5 of the middle antenna element 5 is 1,590 mm and the length l6 of the innermost antenna element 6 is 1,615 mm. Other parameters are a = 66 mm, b = 39 mm, c = 108 mm, d = 39 mm, e = 64 mm, f = 38 mm, g = 80 mm, h = 67 mm. i = 75 mm, j = 40 mm and k = 5 mm.

Figure 6:
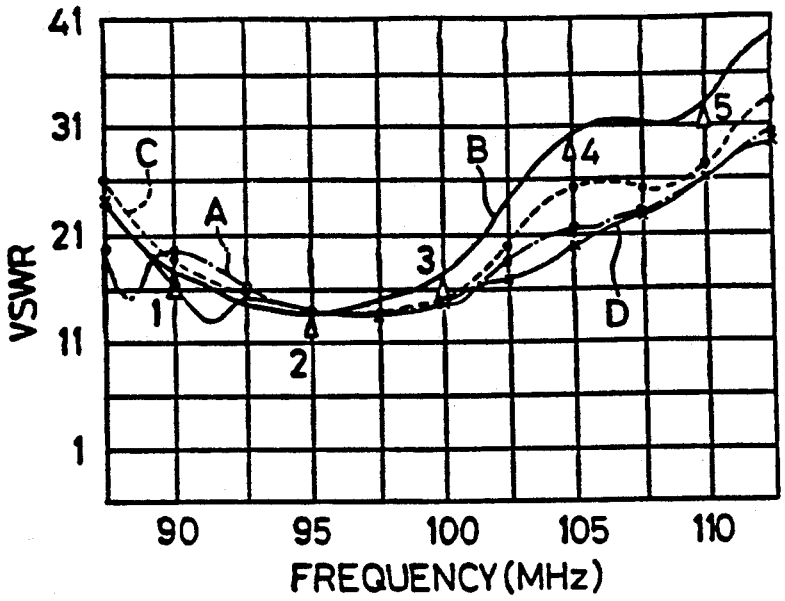
FIG. 6 is a graph showing a voltage standing wave ratio against frequency for different number of the antenna elements.

Referring to FIG. 6, there is shown a graph of VSWR versus frequency for different numbers of loop-like antenna elements. Curve A was plotted when using three loop antenna elements exemplified in FIG. 1. Curve B was obtained with a single loop antenna element such as shown in FIG. 2. Two loop antenna elements resulted in curve C and four loop antenna elements provided curve D. As is clearly shown in FIG. 6, the curve B with a single antenna element has higher VSWR to the right-hand of the graph, or higher frequency side-band. VSWR is a measure of mismatching of impedance between the antenna and the feeder. Such mismatched antenna impedance was substantially improved by the use of a plurality of loop antenna elements as depicted from curves A, C and D for three, two and four elements, respectively.

Figure 7:
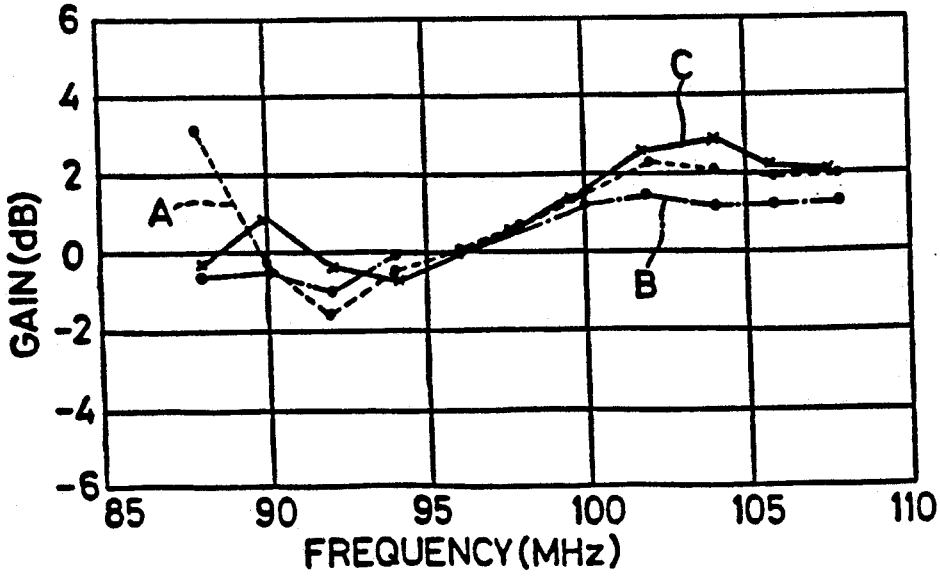
FIG. 7 is a graph showing a relative antenna gain against frequency for different number of the antenna elements.

The antenna gain, which is a measure of the power available for the receiver system, was similarly improved as seen from the graph of FIG. 7 showing a relative antenna gain versus frequency for different numbers of loop-like antenna elements. Curve A was measured with the triple-element window antenna shown in FIG. 1. Curve B was obtained with a dual-element antenna, and Curve C with a guard-element antenna. Each curve is normalized by the reference antenna gain obtained for a single loop-like antenna element shown in FIG. 2, and indicated here in FIG. 7 by the zero decibel horizontal line. Having employed a plurality of loop-like antenna elements (three for the curve A, two for the B and four for the C in FIG. 7) with suitable dimensions, a considerable improvement was observed on the antenna gain over the reception band and particularly in higher frequencies. Such improvement on the antenna gain may be comparable to the improvement on the voltage standing wave ratio as depicted in FIG. 6 in which three elements were used for the curve A, one for the B, two for the C and four for the D. In FIG. 7 the increased antenna gain observed in the higher band is shown by a value relative to the reference antenna gain measured for the single loop-like element. The antenna gain of the latter is illustrated in FIG. 3 by the curve A, according to which a decreased antenna gain is observed in the higher band. Therefore, we can say that the use of plural loop-like antenna elements has stabilized the actual antenna gain or power available in the entire reception band.

This concludes the description of a preferred embodiment of the invention. However, many modifications and variations will be obvious to those of ordinary skill in the art. For example, an ornamental or auxiliary strip conductor of the antenna element as discussed in connection with FIG. 1 may be omitted if desired. Each antenna element 4, 5, 6 as well as the lead 10*a* could be made from a transparent material. The reception band of 85 to 110 MHz discussed in the embodiment is merely exemplary, and will have a different range according to the receiver system involved. Preferred values of the space d, f, h, j formed between the outmost antenna element 4 and the window frame 2 have been found to range from 20 to 120 mm. While a four-sided window is shown in the embodiment, windows of different shapes such as triangle, oval and circle could be used. Also, a curved window glass such as windshield glass could be employed. The appended claims are therefore intended to cover all such modifications and variations.

We claim:

1. A vehicle window antenna mounted on a window glass set in a window frame of a vehicle comprising:

a plurality of antenna elements disposed in concentric form over a portion of said glass which are spaced from about 20 to 120 mm from said frame and extend generally parallel thereto; said window frame having four sides, each of said antenna elements extending alongside said four sides of said window frame, each of said antenna elements being connected at one end to a common antenna feed pad mounted on said glass, whereas the other ends of said antenna elements are free, and each of said antenna elements having an effective length which is different from one another.

2. The vehicle window antenna according to claim 1 wherein said window frame is a frame which forms a window located on the right-hand side of an automobile.

3. The vehicle window antenna according to claim 1 wherein said window frame is a frame which forms a window located on the left-hand side of an automobile.

4. The vehicle window antenna according to claim 1 wherein said plurality of antenna elements comprise a plurality of printed strip conductors.

5. The vehicle window antenna according to claim 1 wherein at least one of said plurality of antenna elements comprises a first strip conductor determining the effective length of the antenna element and an auxiliary strip element disposed between the ends of said first strip conductor, said first strip conductor and said auxiliary strip element having a gap therebetween.

6. A window glass with an antenna and arranged to fit into a window frame of a vehicle comprising:

an antenna conductor pattern having a plurality of antenna elements which are different in length from each other;

said pattern being disposed in concentric form on a portion of said window glass such that said pattern is spaced from about 20 to 120 mm from said window frame when said window glass is fit in said window frame;

said window frame having four sides, each of said antenna elements extending alongside said four sides of said window frame, and each of said antenna elements being connected at one end to a common antenna feed pad mounted on said glass, whereas the other ends of said antenna elements are free.

* * * * *